US006624414B1

(12) United States Patent
Glesener

(10) Patent No.: US 6,624,414 B1
(45) Date of Patent: Sep. 23, 2003

(54) IMAGE INTENSIFIER TUBE WITH IR UP-CONVERSION PHOSPHOR ON THE INPUT SIDE

(75) Inventor: John W. Glesener, Richardson, TX (US)

(73) Assignee: Litton Systems, Inc., Woodland Hills, CA (US)

( * ) Notice: Subject to any disclaimer, the term of this patent is extended or adjusted under 35 U.S.C. 154(b) by 0 days.

(21) Appl. No.: 09/382,873

(22) Filed: Aug. 25, 1999

(51) Int. Cl.[7] ..... H01J 31/49; H01J 31/50

(52) U.S. Cl. ..... 250/333; 250/214 VT; 313/527; 313/543

(58) Field of Search ..... 250/333, 214 VT; 313/103 CM, 105 CM, 525, 527, 543

(56) References Cited

U.S. PATENT DOCUMENTS

| | | | | |
|---|---|---|---|---|
| 3,892,966 A | * | 7/1975 | Riedel et al. | 250/333 |
| 4,730,141 A | * | 3/1988 | Tosswill | 250/333 |
| 4,839,569 A | * | 6/1989 | Dallin, II | 250/214 VT |
| 4,891,507 A | * | 1/1990 | Lindmayer et al. | 250/214 VT |

* cited by examiner

*Primary Examiner*—Zandra V. Smith
(74) *Attorney, Agent, or Firm*—Baker Botts L.L.P.

(57) ABSTRACT

The present invention comprises an enhanced vision device having an image intensifier tube (16) with an input end (17*a*) and an output end (17*b*) with an IR phosphor (19) deposited on the input end (17*a*) of the image intensifier tube (16). The IR phosphor (19) produces photons in response to light of wavelengths that would be undetectable by the image intensifier tube (16).

16 Claims, 1 Drawing Sheet

IMAGE INTENSIFIER TUBE WITH IR UP-CONVERSION PHOSPHOR ON THE INPUT SIDE

TECHNICAL FIELD OF THE INVENTION

This invention relates to enhanced vision systems and, more particularly, to an image intensifier tube with IR up-conversion phosphor.

BACKGROUND OF THE INVENTION

One type of enhanced vision systems is night vision equipment used by military personnel. Night vision equipment has proven its usefulness in many combat situations. As technology improved, so has the use of night vision equipment. However, there are some drawbacks to night vision equipment. One drawback is that standard Generation III night vision equipment is insensitive to light having a wavelength longer than 0.9 microns. These wavelengths are important because laser beams with wavelengths of 1–3 microns are used in tactical situations. Among the uses of such lasers is the targeting of infantry personnel. Thus, it would be beneficial for infantry personnel to know if targeting lasers were being used.

SUMMARY OF THE INVENTION

In accordance with the teachings of the present invention, an image intensifier tube whose input is coated with an IR up-conversion phosphor. This image intensifier tube provides advantages over previously developed image intensifier tubes.

In one embodiment, an enhanced vision device is provided. The enhanced vision device comprises an image intensifier tube having an input end and an output end with an IR phosphor deposited on the input end of the image intensifier tube. The IR phosphor produces photons in response to light of wavelengths that would be undetectable by the image intensifier tube.

A technical advantage of the present invention is that light of wavelengths previously undetectable by image intensifier tubes are able to be detected. Additional technical advantages can be readily apparent from the following figures, descriptions and claims.

BRIEF DESCRIPTION OF THE DRAWINGS

For a more complete understanding of the present invention, the objects and advantages thereof, reference is now made to the following descriptions taken in connection with the accompanying drawings in which.

DETAILED DESCRIPTION OF THE DRAWINGS

Figure 1:
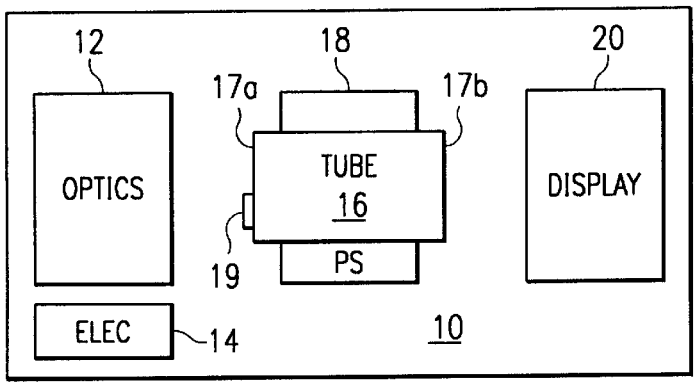
FIG. 1 is a schematic diagram of an image intensifier with infrared phosphor.

The preferred embodiment of the present invention and its advantages are best understood by referring to FIGS. 1 of the drawings, like numerals being used for like and corresponding parts of the various drawings.

FIG. 1 is a schematic design of an image intensifier 10 in accordance with the teachings of the present invention. Image intensifier 10 is operable to receive photons from an image and transform them into a viewable image. Image intensifier 10 is designed to operate and enhance viewing in varying light conditions including conditions where a scene is visible with natural vision and conditions where a scene is totally invisible with natural vision because the scene is illuminated only by star light or other light sources. However, it will be understood that, although the image intensifier 10 may be used to enhance vision, the image intensifier 10 may also be used in other applications involving photon detection such as systems to inspect semiconductors.

Image intensifier 10 comprises optics 12 coupled to image intensifier tube 16. Image intensifier tube 16 has an input end 17*a* and an output end 17*b*. Image intensifier 10 is operable to act as a photon detector and image generator. Power supply 18 is coupled to image intensifier tube 16. Image intensifier tube 16 may also include a display 20 for enhancing the image produced by image intensifier tube 16.

Optics 12 are generally one or more lens elements used to form an objective optical assembly. Optics 12 are operable to focus light from a scene on to image intensifier tube 16.

Power supply 18 is operable to provide power to components of image intensifier tube 16. In a typical embodiment power supply 18 provides continuous DC power to image intensifier tube 16. The use of power supply 18 is further described in conjunction with FIG. 2.

Electronics 14 represents the other electronic necessary for image intensifier 10. These include electronics that are used to control among other things, power supply 16.

Display 20 may be provided as a convenient display for images generated by image intensifier tube 16. Display 20 may be optics which can deliver the images produced by image intensifier tube 16 to the user or may include the necessary electronics such as a camera in order to display the image produced by image intensifier tube 16 on a cathode ray tube (CRT) display.

Figure 2:
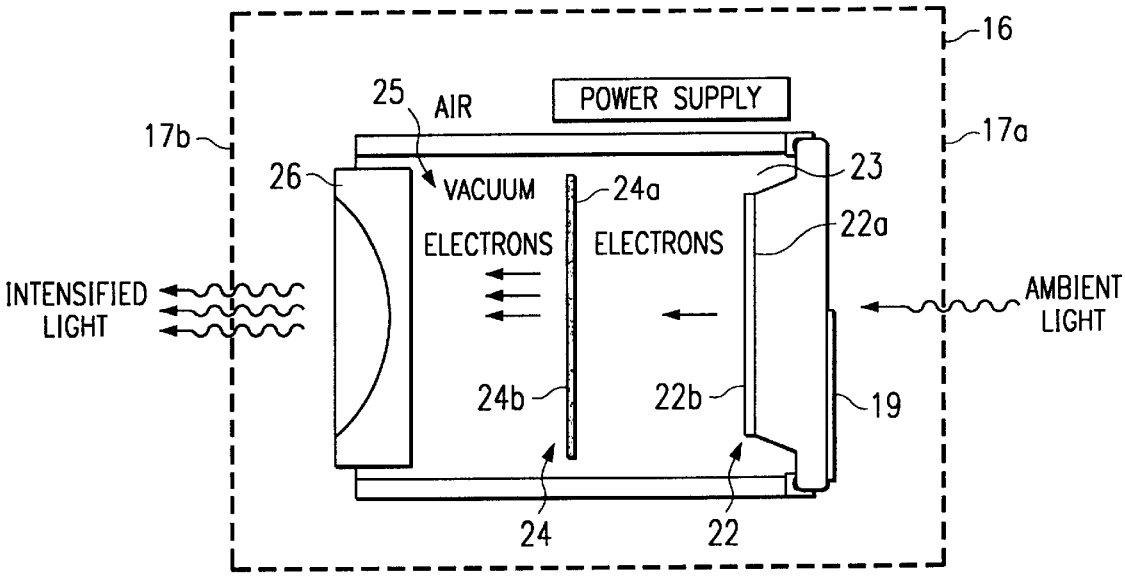
FIG. 2 illustrates an image intensifier tube 16 in accordance with the teachings of the present invention.

FIG. 2 illustrates an image intensifier tube 16 in accordance with the teachings of the present invention. Image intensifier tube 16 comprises a photocathode 22 having an input side 22*a* and an output side 22*b*. Coupled to photocathode 22 is a microchannel plate (MCP) 24 having a MCP input side 24*a* and a MCP output side 24*b*. A first electric field 23 is located between photocathode 22 and microchannel plate 24. Also included is a phosphorous screen 26 coupled to microchannel plate 24. Between phosphorous screen 26 and microchannel plate 24 is a second electric field 25. At the input side of 17*a* of image intensifier tube 16, in front of photocathode 22 is an IR phosphor 19, which covers all or part of input side 22*a* of photocathode 22. (Or can be placed on optics 12) One type of suitable IR phosphor 19 is copper or manganese doped zinc sulfide.

In operation, photons from an image impinge on input side of photocathode 22*a*. Photocathode 22 converts photons into electrons, which are emitted from output side of photocathode 22*b* in a pattern representative of the original image. Typically, photocathode 22 is a circular disk like structure manufactured from semiconductor materials mounted on a substrate as is well known in the art. One suitable arrangement is gallium arsenide (GaAs) mounted on glass, fiber optics or similarly transparent substrate.

The electrons emitted from photocathode 22 are accelerated in first electric field 23. First electric field 23 is generated by power supply 18. After accelerating in first electric field 23, the electrons impinge on the input side 24*a* of microchannel plate 24. Microchannel plate 24 typically comprises a thin glass wafer formed from many hollow fibers; each oriented slightly off axis with respect to incoming electrons. Microchannel plate 24 typically has a conductive electrode layer disposed on MCP input side 24*a* and MCP output side 24*b*. A differential voltage, supplied by power supply 18, is applied across the MCP input 24*a* and MCP output 24*b*. Electrons from photocathode 22 enter microchannel plate 24 where they produce secondary electrons, which are accelerated by the differential voltage. The accelerated secondary electrons leave microchannel plate 24 at MCP output 24*b*.

After exiting microchannel plate 24 and accelerating in second electric field 25, secondary electrons impinge on phosphorous screen 26, where a pattern replicating the original image is formed. Other ways of displaying an image such as using a charged-coupled device can also be used.

By adding IR phosphor 19, infrared light not normally detectable by photocathode 12 can be detected. When IR phosphor 19 is placed at the input end 17*a* of the image intensifier tube 16 near photocathode 12. Infrared light of 1 to 3 microns in wavelength impinges on IR phosphor 19, photons of a wavelength detectable by photocathode 12 is emitted by IR phosphor 19 and sent to photocathode 12. As these photons are converted to electrons and sent through the image intensifier tube 16, the output would be a bright flash of light. If IR phosphor 19 covers all of photocathode 12, then the entire screen would produce a bright flash in response to infrared light. Alternatively, IR phosphor 19 can be placed in a certain pattern, like an "x" in front of photocathode 12. Then, incident IR light could produce a bright x-shaped flash at the output of image intensifier tube 10.

While the invention has been particularly shown and described by the foregoing detailed description, it will be understood by those skilled in the art that various other changes in form and detail may be made without departing from the spirit and scope of the invention.

What is claimed is:

1. An enhanced vision device, comprising:

an image intensifier tube having an input end and an output end; and an infrared (IR) phosphor element positioned proximate to the input end of the image intensifier tube, the IR phosphor element operable to generate a plurality of photons corresponding to an image that is based on wavelengths of light received by the image intensifier tube, the image intensifier tube including:

a photocathode coupled to the IR phosphor element and operable to receive the photons and to convert the photons into an electron flow associated with the image;

a microchannel plate operable to receive the electron flow substantially unreflected from the photocathode and to generate an electric field proximate to the electron flow such that the electron flow is excited; and a phosphorus screen operable to receive the electron flow from the microchannel plate and to replicate a portion of the image received by the image intensifier tube based on the electron flow.

2. The device of claim 1, wherein the IR phosphor element is operable to detect light having a wavelength of approximately 1 to 3 microns.

3. The device of claim 1, wherein the IR phosphor element is deposited on the input end of the image intensifier tube in a pattern.

4. The device of claim 1, wherein the IR phosphor element is formed from material of a selected one of copper and manganese doped zinc sulfide.

5. The device of claim 1, further comprising an optical element operable to focus a portion of the wavelengths associated with the image onto the image intensifier tube.

6. The device of claim 1, further comprising a display element operable to receive the portion of the image replicated by the phosphorous screen and to display the portion for viewing.

7. The device of claim 1, further comprising electronics operable to control a power supply that is coupled to the image intensifier tube.

8. A method for detecting light energy, the method comprising:

receiving wavelengths of light emitted by an image;

generating photons based on the wavelengths of light, the wavelengths of light propagating in a substantially unreflected fashion;

receiving the photons and converting the photons into an electron flow associated with the image;

receiving the electron flow and producing additional electrons based on the electron flow using a microchannel plate;

generating an electric field proximate to the electron flow such that the electron flow is excited; and replicating a portion of the image based on the excited electron flow.

9. The method of claim 8, wherein the wavelengths of light are in a range of approximately 1 to 3 microns.

10. The method of claim 8, further comprising positioning an infrared (IR) phosphor element such that it receives the wavelengths of light emitted by the image, the IR phosphor element forming a pattern reflective of the image.

11. The method of claim 10, wherein the IR phosphor element is formed from material of a selected one of copper and manganese doped zinc sulfide.

12. The method of claim 8, further comprising displaying the portion of the image such that it may be viewed.

13. A photon detection device, comprising:

an image intensifier tube having an input end and an output end; and an infrared (IR) phosphor element positioned proximate to the input end of the image intensifier tube, the IR phosphor element operable to generate a plurality of photons corresponding to an image that is based on wavelengths of light received in the infrared system by the image intensifier tube, the image intensifier tube including:

a photocathode coupled to the IR phosphor element and operable to receive the photons and to convert the photons into an electron flow associated with the image;

a microchannel plate operable to receive the electron flow substantially unreflected from the photocathode and to generate an electric field proximate to the electron flow such that the electron flow is excited; and a phosphorus screen operable to- receive the electron flow from the microchannel plate and to replicate a portion of the image received by the image intensifier tube based on the electron flow.

14. The device of claim 13, wherein the IR phosphor element is operable to detect light having a wavelength of approximately 1 to 3 microns.

15. The device of claim 13, wherein the IR phosphor element is deposited on the input end of the image intensifier tube in a pattern.

16. The device of claim 13, wherein the IR phosphor element is formed from material of a selected one of copper and manganese doped zinc sulfide.

* * * * *